US005755260A

United States Patent [19]

Cho

[11] Patent Number: 5,755,260

[45] Date of Patent: May 26, 1998

[54] MONO-BLOCK CONTROL VALVE WITH REGENERATION CONDUIT

[75] Inventor: Hyung Joon Cho, Changwon, Rep. of Korea

[73] Assignee: Samsung Heavy Industries Co., Ltd., Seoul, Rep. of Korea

[21] Appl. No.: 497,096

[22] Filed: Jun. 30, 1995

[30] Foreign Application Priority Data

Sep. 29, 1994 [KR] Rep. of Korea ..... 94-24707
Sep. 30, 1994 [KR] Rep. of Korea ..... 94-25150

[51] Int. Cl.[6] ..... F15B 11/08

[52] U.S. Cl. ..... 137/596.12; 137/596.2

[58] Field of Search ..... 137/596, 596.12, 137/596.13, 596.2; 91/420

[56] References Cited

U.S. PATENT DOCUMENTS 3,267,966 8/1966 Williams ..... 137/596.12 X 4,170,246 10/1979 Johnson ..... 137/596.12

*Primary Examiner*—Kevin Lee

*Attorney, Agent, or Firm*—Kenyon & Kenyon

[57] ABSTRACT

A mono-block control valve having a regeneration conduit is disclosed. The regeneration conduit does not enlarge the valve body. The control valve has a bypass conduit formed in either side of the valve body. The bypass conduit is opened to return the pressurized oil of the hydraulic pump to a return tank if the spool is in a neutral position, but closed if the spool moves. Two actuator ports are formed in each section of the body. The ports supply the pressurized oil of the pump to a supply side of each actuator and for returning the oil coming out of the return side of each actuator to the return tank respectively. A regeneration conduit is formed in a bottom portion of the body and connects the two actuator ports to each other. The control valve further includes a check valve and a pilot conduit.

5 Claims, 3 Drawing Sheets

MONO-BLOCK CONTROL VALVE WITH REGENERATION CONDUIT

BACKGROUND OF THE INVENTION

1. Field of the Invention

The present invention relates in general to a mono-block control valve used in hydraulic circuits and, more particularly, to a structural improvement in such a mono-block control valve for providing a regeneration conduit in the valve body and maximizing the regeneration effect and easily selecting the regenerating function as desired using a simple selecting structure.

2. Description of the Prior Art

In various types of hydraulic machines such as construction heavy equipment, the actuators are operated by pressurized oil delivered from a hydraulic pump. The actuators are thus provided with their control valves.

The mono-block control valve integrates the control valves of the actuators into a single body. The conduits for connecting the control valves are formed in the single body of the mono-block control valve so that the durability of the mono-block control valve can be remarkably improved. Furthermore, as the mono-block control valve can be exclusively used differently from the separated control valves commonly used, the mono-block control valve has been widely used.

"Regeneration" means that the return oil coming out of the return port of an actuator is partially supplied to the supply port of the actuator and prevents possible cavitation in the supply side of the actuator and achieves the desired operational speed of the actuator. For example, the high pressure return oil obtained by the weight of the boom in a boom-down motion is supplied to the supply side of the actuator to be used in a continued boom-up motion.

With reference to FIGS. 1 and 2, there is shown a control valve having a typical structure for regeneration. A regeneration spool 103 is received in the main spool 101 of the control valve and biased by a pressure setting spring 102 having a given biasing force. The regeneration spool 103 moves due to the pressure of the actuator to open or close the conduits of the valve. When the main spool 101 moves in the "A" direction of FIG. 1, a conduit 104 communicating the actuator port C and the interior of the main spool 101 is opened so that the pressure of the actuator port C biases the regeneration spool 103 in the "B" direction of FIG. 2. Therefore, a part of the oil coming out of the actuator port C returns to a return tank T through a return conduit 105, while the other part of the oil is supplied to the hydraulic pump P to be regenerated.

However, as the above regeneration structure carries out the regeneration through the regeneration conduit formed in the main spool, there is a limit in the regeneration conduit size. The above structure can not provide the desired regeneration effect due to the limited size of the conduit. The conduit formed in the main spool also makes the internal structure of the main spool complicated and increases expenses of the valve. The typical regeneration structure carries out the regeneration through the conduit which is not formed in the mono-block but formed in the main spool as the mono-block size will be increased when an additional conduit is formed in the mono-block.

Korean Patent Appln. No. 94-24400 (filed by this applicant on Sep. 28, 1994) discloses a mono-block control valve having a side bypass conduit. In this mono- block control valve, the bypass conduit (side bypass conduit) is formed in either side of the mono-block body differently from the center bypass conduit formed in the center of a typical mono-block control valve body. This control valve thus removes the bridge, typically used for connecting the right and left actuator ports to a parallel conduit, from the body and reduces the body size or the height of the mono-blockcontrol valve. When the valve body size is not reduced, there is formed a surplus space in the mono-block body as the bridge is removed from the body as described above. As a result of continuous study of the mono-block control valve, this applicant knows that when using the surplus space of the body, the regeneration conduit can be formed in the mono-block control valve without enlarging the body.

SUMMARY OF THE INVENTION

It is, therefore, an object of the present invention to provide a mono-block control valve in which the above problems can be overcome and which has a regeneration conduit and does not enlarge the valve body and thereby remarkably simplifying the regeneration structure and cutting down expenses of the valve and maximizing the regeneration effect.

It is another object of the present invention to provide a mono-block control valve which easily selects the regenerating function as desired using a simple selecting structure.

In order to accomplish the above objects, the invention provides a mono-block control valve having a plurality of sections corresponding to control valves in a body and applying the pressurized oil of a hydraulic pump to a plurality of actuators through the sections, comprising: a bypass conduit formed in either side of the body such that the bypass conduit passes all of the sections, the bypass conduit being opened to return the pressurized oil of the hydraulic pump to a return tank in the case of neutral position of a spool of each section but closed in the case of movement of the spool; two actuator ports formed in each section, the ports being adapted for supplying the pressurized oil of the hydraulic pump to a supply side of each actuator and for returning the oil discharged from a return side of each actuator to the return tank respectively; and a regeneration conduit formed in a bottom portion of the body and connecting the two actuator ports to each other therethrough.

The control valve of this invention may further include a check valve installed in the regeneration conduit and biased by a pressure setting spring to close the regeneration conduit; and a pilot conduit extending to a spring chamber of the check valve and adapted for applying pilot oil to the spring chamber to forcibly close the check valve.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
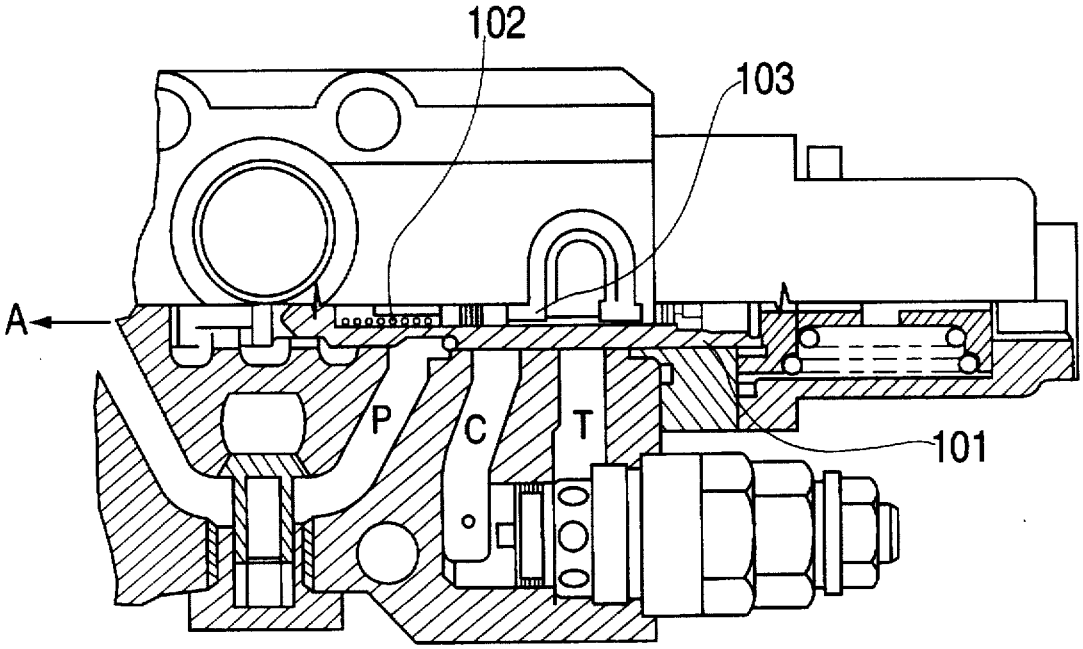
FIG. 1 PRIOR ART
FIG. 1 is a partially sectioned view of a control valve having a typical structure for regeneration.
Figure 2:
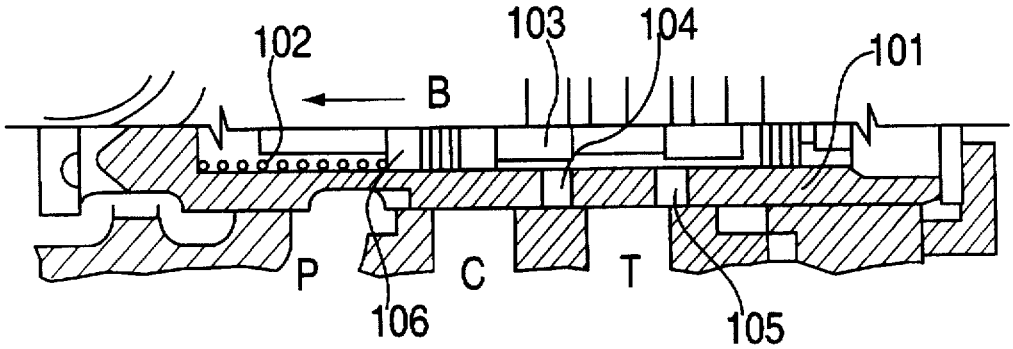
FIG. 2 PRIOR ART
FIG. 2 is a partially enlarged sectional view of the control valve of FIG. 1.
Figure 3A:
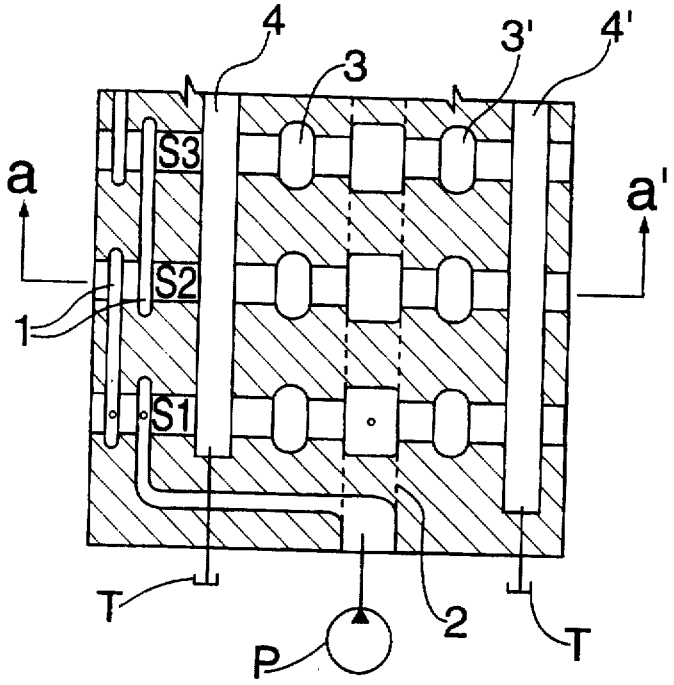
FIG. 3A is a vertical, sectional view of a mono-block control valve with a plurality of sections corresponding to control valves in a body in accordance with a primary embodiment of the invention.

FIG. 3A is a vertical, sectional view of a mono-block control valve with a plurality of sections corresponding to control valves in a body in accordance with a primary embodiment of the invention. In the embodiment of FIG. 3A, the reference numerals S1, S2 and S3 indicate the sections corresponding to control valves for the respective actuators, for example, a boom cylinder, a bucket cylinder, an arm cylinder, in which figure the spools are not shown for the sake of simplicity. Note that a side bypass conduit 1 and a parallel conduit 2 passes, i.e., traverses, all of the sections of the mono-block control valve. FIG. 3B is a transverse, sectional view of a mono-block control valve of FIG. 3A with a regeneration conduit taken along the line a–a' in FIG. 3A, wherein the spool is positioned in the operating position. In the embodiment of FIG. 3, the regeneration structure is formed in one, needing the regenerating function and suitable for forming the regeneration structure, of a plurality of sections formed in the valve body B of a cast body. For example, the regeneration structure may be formed in the boom cylinder control valve section of the valve body B.

As shown in the drawing, a parallel conduit 2 is formed in the center of the valve body B and right and left actuator ports 3' and 3 are formed in the right and left sides of the parallel conduit 2. When the spool 5 moves in the body B, the pressurized oil of the parallel conduit 2 is supplied to an associated actuator A through one, for example, the left port 3, of the two ports 3 and 3' and returned to the return tank T through the other port, for example, the right port 3'. A pair of return conduits 4 and 4' are formed in the body B outside the ports 3 and 3'. The return conduits 4 and 4' extend to the return tank T after passing, i.e., traversing, all of the sections of the body B. A side bypass conduit 1 is formed in the body B outside either of the return conduits 4 and 4'. In FIG. 3B the bypass conduit 1 is closed by the spool 5, so that a pressurized oil delivered by a pump P, which is shown in FIG. 3A, is supplied to a mono-block control valve via a parallel conduit 2.

Figure 3C:
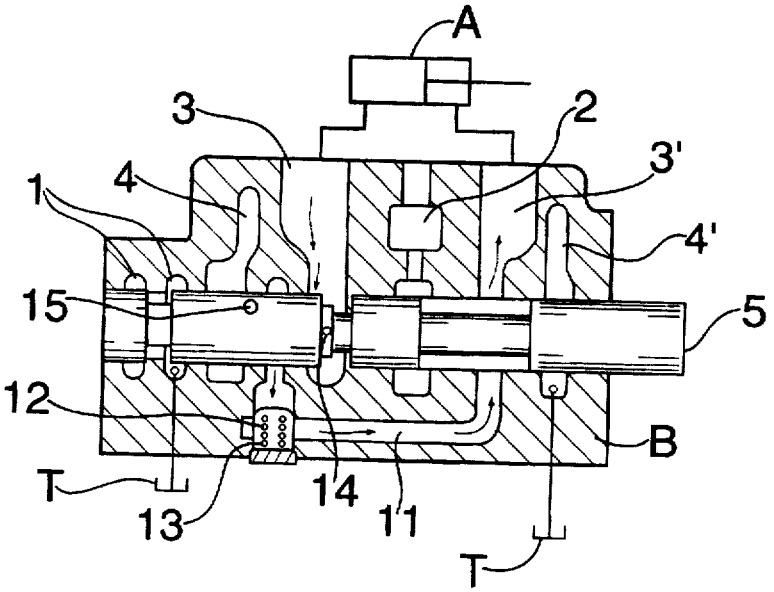
FIG. 3C is a transverse, sectional view of a mono-block control valve of FIG. 3A with a regeneration conduit taken along the line a–a' in FIG. 3A, wherein the spool is positioned in the neutral position.
Figure 3B:
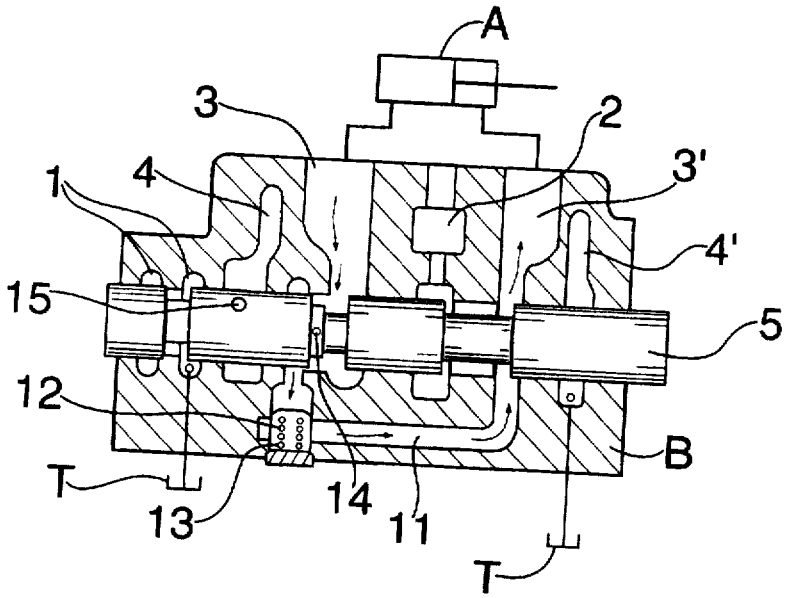
FIG. 3B is a transverse, sectional view of mono-block control valve of FIG. 3A with a regeneration conduit taken along the line a–a' in FIG. 3A, wherein the spool is positioned in the operating position.

FIG. 3C is a transverse, sectional view of a mono-block control valve of FIG. 3A with a regeneration conduit taken along the line a-a' in FIG. 3A, wherein the spool is positioned in the neutral position. In FIG. 3C, the bypass conduit 1 is opened. Therefore, a pressurized oil delivered by a pump P returns to a return tank T via a bypass conduit 1.

In the above mono-block control valve, the side bypass conduit 1 is substituted for the typical center bypass conduit so that the control valve needs no bridge for connecting the actuator ports 3 and 3' to the parallel conduit 2. The mono-block control valve size or the valve body height is thus reduced.

In the primary embodiment, a regeneration conduit 11 for connecting the actuator ports 3 and 3' is formed together in the bottom portion of the body B using the surplus space defined in the body B due to the side bypass conduit 1. A check valve 12 is installed in the regeneration conduit 11. The valve 12 is biased by a pressure setting spring 13 to elastically close the regeneration conduit. In FIG. 3, the reference numerals 14 and 15 denote oil drain holes which are formed in the spool 5 and let the left actuator port 3 communicate with the left return conduit 4 therethrough.

In the above mono-block control valve, a part of the return oil coming out of the left actuator port 3 or the return port of the actuator A is returned to the return tank T through the oil drain holes 14 and 15. The other part of the return oil coming out of the port 3 overcomes the spring force of the pressure setting spring 13 installed in the check valve 12 and biases the spring 13 down in the drawing and thereby flowing into the opened regeneration conduit 11. The return oil is supplied to the right actuator port 3' or the supply port of the actuator A to be regenerated. When the return oil of the left actuator port 3 has a lower pressure, the return oil can not move the check valve 12 and is not regenerated.

The oil regeneration of the mono-block control valve of this invention is achieved by the regeneration conduit 11 so that the regeneration conduit size is not limited differently from the typical regeneration structure formed in the spool. The control valve of this invention can achieve the desired regeneration effect.

The regeneration structure of this invention is formed using the surplus space defined in the body due to the side bypass conduit. Thus, the regeneration structure does not increase the control valve size even though the regeneration conduit is separately formed in the body B.

Figure 4:
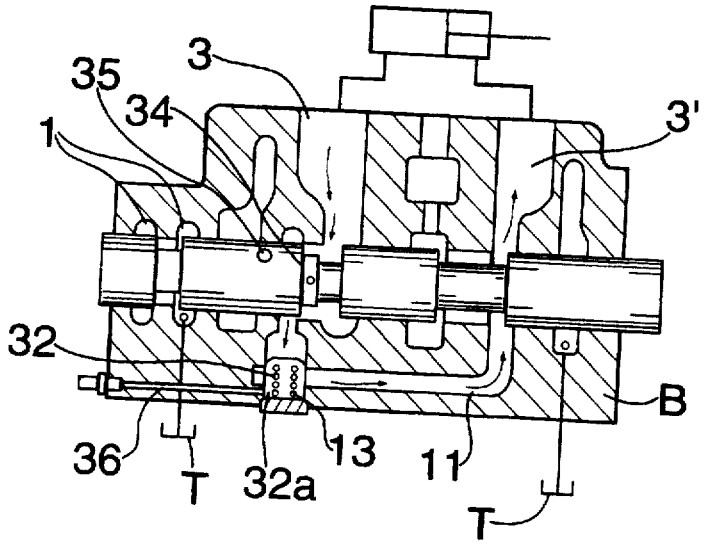
FIG. 4 is a sectional view of a mono-block control valve with a regeneration conduit in accordance with a second embodiment of the invention.

FIG. 4 is a sectional view of a mono-block control valve with a regeneration conduit in accordance with a second embodiment of the invention. In the second embodiment, a check valve 32 is installed in the regeneration conduit 11, the conduit 11 being formed in the body B in the same manner as described for the primary embodiment. The valve 32 is biased by a pressure setting spring 33 to elastically close the regeneration conduit 11. A pilot conduit 36 extends to the spring chamber 32*a* of the check valve 32 and applies the pilot oil to the spring chamber 32*a* to forcibly close the check valve 32. In FIG. 4, the reference numerals 34 and 35 denote oil drain holes which are formed in the spool 5 and let the left actuator port 3 communicate with the left return conduit 4 therethrough.

When the pressure of the return oil coming out of the left actuator port 3 or the return port of the actuator A is lower than the pressure preset by the pressure setting spring 33, the return oil can not open the check valve 32 so that all of the return oil is returned to the return tank through the drain holes 34 and 35. However, when the pressure of the return oil coming out of the left actuator port 3 is higher than the pressure preset by the pressure setting spring 33, a part of the return oil is returned to the return tank through the drain holes 34 and 35. The other part of the return oil pushes the check valve 32 down in the drawing and opens the valve 32 so that the return oil is partially supplied to the supply port 3' through the regeneration conduit 11 to be regenerated. When it is required to prevent the regeneration even though the pressure of the return oil coming out of the left actuator port 3 is higher than the pressure preset by the pressure setting spring 33, the pilot oil is supplied to the spring chamber 32*a* of the check valve 32 through the pilot conduit 36 to forcibly close the check valve 32. Therefore, the mono-block control valve of this invention easily selects the regenerating function using the simple selecting structure.

As described above, the mono-block control valve of this invention is provided with a regeneration conduit but does not increase the body size and thereby simplifying the regeneration structure and cutting down expenses of the valve and maximizing the regeneration effect. Another advantage of the control valve of this invention is resided in that the control valve easily selects the regenerating function using the simple selecting structure and more precisely operates the hydraulic machines reliability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A mono-block control valve having a plurality of sections corresponding to control valves in a body and applying the pressurized oil of a hydraulic pump to a plurality of actuators through the sections, comprising:

a bypass conduit formed in either side of said body such that the bypass conduit traverses all of the sections, said bypass conduit being opened to return the pressurized oil of the hydraulic pump to a return tank in the case of neutral position of a spool reciprocating through said sections but closed in the case of movement of the spool;

two actuator ports formed in each section, said ports being adapted for supplying the pressurized oil of the hydraulic pump to a supply side of each actuator and for returning the oil discharged from a return side of each actuator to the return tank respectively; and a regeneration conduit formed in a bottom portion of the body and connecting the two actuator ports to each other.

2. The mono-block control valve according to claim 1, further comprising an oil drain hole formed in the spool and adapted for returning a part of the return oil coming out of a return actuator port of the two actuator ports to the return tank.

3. The mono-block control valve according to claim 1, further comprising a check valve installed in the regeneration conduit and biased by a pressure setting spring to close the regeneration conduit.

4. The mono-block control valve according to claim 3, further comprising a pilot conduit extending to a spring chamber of the check valve and adapted for applying pilot oil to the spring chamber to forcibly close the check valve.

5. The mono-block control valve according to claim 2 further comprising a check valve installed in the regeneration conduit and biased by a pressure setting spring to close the regeneration conduit.

* * * * *